United States Patent [19]

Rau

[11] Patent Number: 4,815,597

[45] Date of Patent: Mar. 28, 1989

[54] STORAGE CONTAINER FOR ELONGATED TOOLS

[75] Inventor: Georg Rau, Hohenmemmingen, Fed. Rep. of Germany

[73] Assignee: Firma Georg Knoblauch, Giengen/Frenz, Fed. Rep. of Germany

[21] Appl. No.: 162,884

[22] Filed: Mar. 2, 1988

[30] Foreign Application Priority Data

Mar. 7, 1987 [DE] Fed. Rep. of Germany ..... 3707343

[51] Int. Cl.[4] ..... B65D 85/28

[52] U.S. Cl. ..... 206/375; 81/437; 81/439

[58] Field of Search ..... 206/234, 374, 375, 379; 81/437, 438, 439; 408/241 R

[56] References Cited

U.S. PATENT DOCUMENTS

| | | | |
|---|---|---|---|
| 3,194,286 | 7/1965 | Wagner | 81/439 |
| 3,750,729 | 8/1973 | Lemieux | 81/439 |
| 3,753,455 | 8/1973 | Butler | 81/439 |
| 4,235,269 | 11/1980 | Kraus | 81/438 |
| 4,468,990 | 9/1984 | Hile | 81/439 X |
| 4,572,038 | 2/1986 | Graham | 81/439 |
| 4,762,036 | 8/1988 | Orlitzky et al. | 81/437 |

*Primary Examiner*—Jimmy G. Foster
*Assistant Examiner*—Nova Stucker
*Attorney, Agent, or Firm*—Herbert Dubno

[57] ABSTRACT

A storage container for elongated tools, particularly for tools with four-sided shanks such as tap drills and screw extractors, having a cylindrical container body with parallel circularly-arranged receptacles for tools, a rotatable cap closing the receptacles with a tool-removal aperture in the cap, the cap being rotatable so as to place the tool removal aperture in juxtaposition to the desired tool receptacle. The container body bears a tool shank clamping assembly having a movable clamping jaw positioned by a cam defined by a hole of specific shape in a cam disk, such that the clamping assembly is adjusted to have a cross-section corresponding to the shank of the desired tool.

10 Claims, 5 Drawing Sheets

STORAGE CONTAINER FOR ELONGATED TOOLS

FIELD OF THE INVENTION

My present invention relates to a storage container for tools, especially for elongated tools such as tap drills, screw extractors and the like, having square shanks.

BACKGROUND OF THE INVENTION

It is known to use cylindrical containers for tools such as tap drills, screw extractors and the like, in particular containers having a series of circularly arranged tool receptacles. It is also known to have a cap on one end of said containers with a tool removal aperture which can be positioned in selective registry with any of the openings of the tool receptacles.

A problem with this sort of tool storage container is that the required auxiliary device needed for the actuation of the tool, most frequently a tap wrench, must either be carried along with the tool storage container or stowed in it, for which there frequently is no suitable space.

OBJECTS OF THE INVENTION

An object of my invention to provide a tool storage container of the type described above, so designed as to obviate the need for any auxiliary tool to put into use the tools in the container.

It is a further object of my invention to provide a container which simplifies and speeds up the deployment of the desired tool.

Yet another object of the invention is to provide a container from which tools are not readily lost.

SUMMARY OF THE INVENTION

The objects of the invention are achieved with a tool container comprising an essentially cylindrical container body with a plurality of circularly arranged tool receptacles parallel to the axis and opening onto one face of the container body, on which face is positioned an axially rotatable cap which closes off the tool receptacles, the cap having a tool removal aperture which can be rotated to be in juxtaposition with and give access to any of the receptacles, and this body having a clamping assembly comprised of at least two clamping jaws with at least one of the clamping jaws being positionable by means of a cam attached nonrotatably to the cap.

This cam operates so that the opening cross-section of the clamping assembly in each rotational position of the cap is set to correspond approximately to the shank cross-section of the tool in the receptacle to which access is given by the tool removal aperture.

The improvement achieved by the invention consists, first, in that the storage container itself serves as a tool installation aid, with the further advantage that the clamping assembly in the container automatically adjusts to the requisite cross-section, so that for the clamping of the tool no special auxiliary tool is needed, which greatly simplifies the preparation needed to use the desired tool.

Since, moreover, the tool can be clamped with a very small rotation of the container cap, the aperture of the cap remains quite near the rotational position needed for removal of the tool. In this way, subsequent stowing away of the tool is facilitated and it is made less likely that other tools will fall out of the container, as could happen from time to time if more extensive rotation of the container were necessary and if the tool removal aperture were to come to a stop over a neighboring receptacle.

In one advantageous feature of the invention, the clamping assembly consists of two clamping jaws, one jaw being attached firmly to the cap and the other jaw being positionable in a guide slot radially located in the container body, each of the two clamping jaws having a right angled clamping surface opposite one another, forming a keyway with a square cross section, and the positionable jaw being positioned, against the outward pressure of a spring, by means of a sliding surface arranged against a cam, this cam being formed by the boundary of a hole in a cam disk located parallel to the face of the container body.

The clamping in of the tool is further simplified by having, on the cam, a series of alternating clamping zones and adjusting zones, whereby the clamping zones are arranged, with respect to the rotational axis of the cap, more circularly and therefore bring about, by the same rotational angle of the cap, a small motion of the clamping jaw, whereas the adjusting zones of the cam have a greater radial excursion, and thereby cause a larger adjustment of the clamping jaw.

This arrangement permits repositioning of the tool removal aperture of the cap from one receptacle to another by means of a small rotational turn, simultaneously bringing about the requisite cross-sectional area of the clamping assembly; then, for the clamping-in of the tool, a sufficient clamping force can be imposed by means of a further twist on the cap.

Thus, when the tool removal aperture of the cap is brought in juxtaposition with one of the tool receptacles, the clamping jaw with its sliding surface becomes positioned at one of the clamping zones, while the sliding surface becomes positioned at one of the adjusting zones when the tool removal aperture is directed between two tool receptacles.

The cam can be constructed in an especially simple form directly on the face of the cap. However, in an advantageous feature of the invention, the cam is constructed as a flat circular insert piece with a diameter corresponding to the inner diameter of the cap, with the cap and the cam disk being linked nonrotatably by at least one interpenetrating protrusion and groove.

This construction is particularly satisfactory if the cap is a plastic part, since the cam disk can then be made of metal. In this way, higher clamping forces can be applied without the risk of damaging the cam.

Advantageously, the positionable clamping jaw has, in a plane perpendicular to its plane of motion, a T-shaped cross-sectional profile and it is guided by a corresponding radial guide slot having a T-shaped cross-section in the container body opening towards the rim as well as toward the face of the container.

Two opposite longitudinal side pieces of the jaw run in slotted portions of this guide slot in a plane parallel to the face, while the perpendicular part of the jaw piece extends to the face and has a protrusion extending beyond the face, this protrusion constituting the sliding surface of the positionable jaw.

In order to achieve an especially smooth and wear-free motion on the cam, the sliding surface is advantageously configured as a semicylinder. Other shapes for the clamping jaw which are functionally equivalent are within the broader purview of the invention.

At the closed end of the guide slot there is advantageously a longitudinal bore provided with a spiral spring, which has its free end positioned on a spherical centering point on the movable jaw, although other means can afford equivalent spring function.

For further simplification of the operation of the storage container of the invention, it is advantageous to have, on the side of the container away from the cap, a gripping arrangement situated axially to the container and to its clamping assembly, this gripping means being rotatable and also axially movable between an engaged and an unengaged position.

Furthermore, there is, on the container body and on the gripping means, a tooth arrangement which engages when the gripping means is pushed into its engaged position, and also a pressure spring, axially disposed between the gripping means and the container body so as to restore the gripping means to its unengaged position. In this way, the hand which is turning the container can stay around the gripping portion, without necessitating regripping, since the gripping part can be brought into the engaged position for the turning direction and into the unengaged position for the counter-rotational turn direction.

BRIEF DESCRIPTION OF THE DRAWINGS

The objects, features and advantages of this invention will be made more readily apparent from the following description, reference being made to the accompanying highly diagrammatic drawing wherein.

Figure 1:
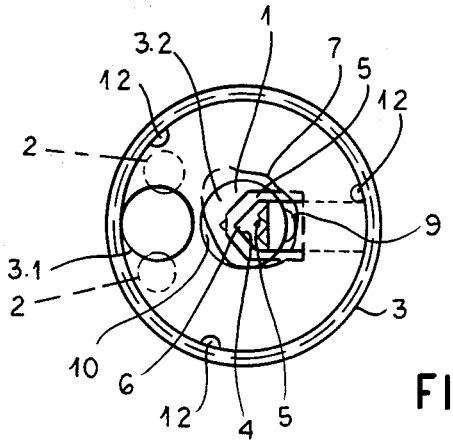
FIG. 1 is a front view of the device of the invention.
Figure 7:
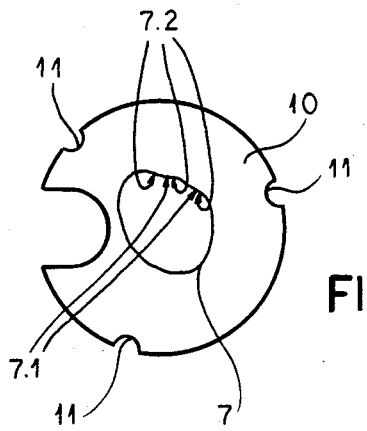
Figure 4:
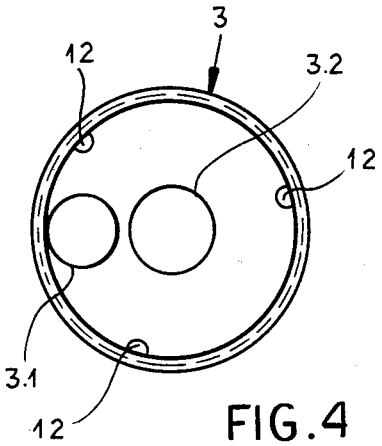
Figure 5:
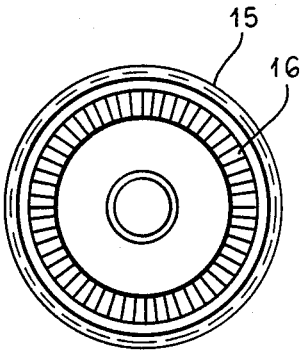
Figure 6C:
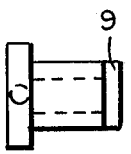
Figure 6B:
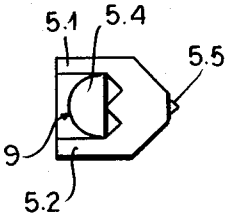
Figure 6A:
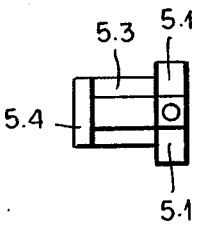
Figure 6D:
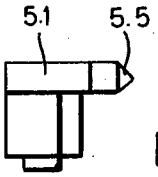

FIG. *3a* is an elevational view of the container;

FIGS. *3b* and *3c* are end views;

FIG. *3d* is a partial elevation;

FIG. 4 is a front view of the container;

FIG. 5 is a front view of the gripping portion;

FIGS. *6a–6d* show the clamping jaw portion in side elevation, top, opposite side elevation and in a side elevation at a right latter angle to; and FIG. 7 is a top view of the cam disk.

SPECIFIC DESCRIPTION

The holder represented in the drawing is especially suited for tools provided with a four sided shank, such as tap drills, screw extractors, and the like, where the shank dimensions depend on the size, in particular the diameter, of the tool.

The holder shown in the drawing comprises an essentially cylindrical container body 1, defining tool receptacles 2 (the tools not being shown in the drawing), these receptacles all being parallel to the axis of the body and opening onto the face 1.1. of the body. On the container body 1, a container cap 3 is rotatably attached, shutting the receptacles 2 on the face side, and having a withdrawal opening 3.1 which depending on its rotary position gives access to one of the receptacles 2 which are arranged in a circle with respect to one another.

In order to make it possible to deploy or change the desired tool by means of a rotary motion, the container body 1 has, on the face 1.1 which is covered by the container cap 3, a clamping assembly 6 consisting of at least two clamping jaws 4 and 5 for the shank of the tool, the clamping assembly being accessible by way of an aperture 3.2 in the container cap 3. One of the clamping jaws 5 is positionable by means of a cam 7 positioned against the container cap 3, which cam operates such that the opening cross-section of the clamping assembly 6 is set to correspond approximately to the shank cross-section of the tool in the receptacle 2 which happens to be in juxtaposition to the tool removal opening 3.1.

In the especially simple embodiment shown in the figure, one of the clamping jaws 4 is solidly affixed to the container body, while the other clamping jaw 5 is held radially positionable in a guide in the container body. Each of the two clamping jaws 4 and 5 is provided with two right angled clamping surfaces facing each other in the manner of a keyway. The displaceable clamping jaw 5 is positioned, against radially-outward pressure of a spring 8, by means of the sliding surface 9 of the cam 7 formed by the boundary of a hole in a cam disk 10 which is parallel to the face 1.1. of the container body 1.

The cam 7 has alternately adjacent clamping zones 7.1 and adjusting zones 7.2 (as shown in FIG. 7), whereby the clamping zones 7.1 in respect to the rotational axis 1.2 of the container cap 3 show a more circular conformation and which therefore upon equivalent angle of rotation of the container cap 3 bring about only a small displacement of the clamping jaw 5.

The adjusting zones 7.2, on the other hand, have a greater radial excursion and therefore bring about a correspondingly greater displacement of the clamping jaw 5.

Upon setting of the removal opening 3.1 in juxtaposition to one of the receptacles 2, the clamping jaw 5 lies with its sliding surface 9 against one of the clamping zones 7.1, so that the tool removed from the receptacle and held in the clamping assembly 6 can be immediately clamped.

It is advantageous that the clamping zone 7.1 at a certain rotational angle of the container cap causes only a small clamping stroke, whereby relatively strong clamping strength is brought to bear. On the other hand, if the removal opening 3.1. is positioned between two of the receptacles 2, then the sliding surface 9 lies against the adjusting zone 7.2 which serve to adjust the clamping cross-section to correspond to the selected tool.

The cam disk 10 is a planar circular insert piece with a diameter corresponding to the inner diameter of the container cap 3. In this regard, the container cap 3 and the cam disk 10 are provided with matching grooves 11 and protrusions 12 to link them nonrotatably.

Figure 2:
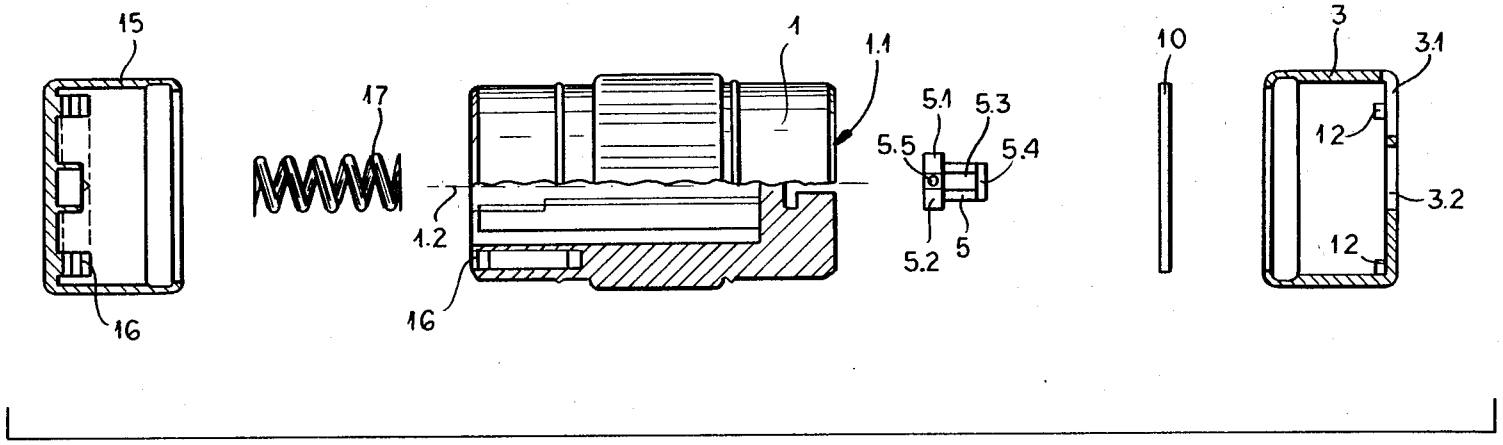
FIG. 2 is an exploded side view of the device of FIG. 1, partly represented in cross-section.
Figure 3C:
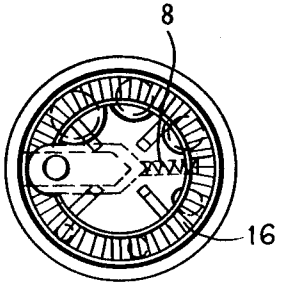
Figure 3A:
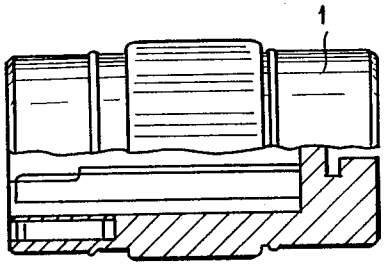
Figure 3B:
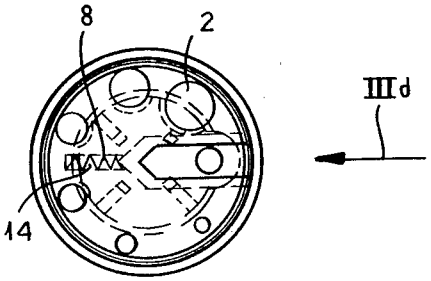
Figure 3D:
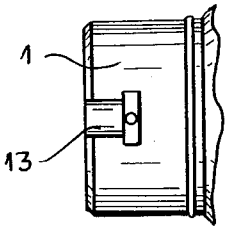

The positionable clamping jaw 5 has, in respect to the plane perpendicular to its direction of movement, an essentially T-shaped cross-section, as may be seen in FIG. 2 and FIG. 6, and inserts into a correspondingly T-shaped groove 13 which runs radially in the container surface opening onto the surface 1.1. Therein, both of the elongated opposite side pieces 5.1 and 5.2 of the clamping jaw 5 move in a plane parallel to the face surface 1.1 of the container body 1, while the piece 5.3 perpendicular thereto extends to the surface 1.1 and supports a projection 5.4 protruding beyond the surface 1.1 and which forms the sliding surface 9.

In order to achieve the most friction-free and wear-free traversal of the sliding surface 9 on the cam 7, there is at the closed end of the groove 13 a bore 14 in the lengthwise in the direction of the groove 13, this bore containing a spiral spring 8. This spiral spring is positioned with its free end on a spherically-shaped centering point 5.5 on the movable clamping jaw.

The container body 1 has on its side away from the container cap 3 a gripping part 15 which is rotatable around the axis 1.2 of the container body 1 and which is axially displaceable between an engaged position and a non-engaged position. On the container body 1 and on the gripping part 15 there are teeth 16 which are caused to mutually engage when the gripping part 15 is in the engaged position. By this means, a rotary engagement between the gripping part 15 and the container body 1 is achieved, which rotary movement is transferred to the tool gripped in the clamping assembly 6. A pressure-imparting spring 17 between the container body 1 and the gripping part 15 provides that the gripping part 15 returns to its unengaged position when it is not being pushed, so that rotation can be continuous without requiring a change of hand grip on the gripping part 15.

The foregoing description is presented in order to set forth advantageous features of the invention but is not intended to be limiting.

I claim:

1. A storage container for elongated tools comprising:

an essentially cylindrical container body, a plurality of receptacles for elongated tools being defined by said body, said receptacles being parallel to the axis of said body, particularly arranged, and opening onto one face of said body;

an axially-rotatable cap on said body, said cap closing said receptacles, and said cap having a tool-removal aperture which depending on the rotary position of said cap gives access to a desired receptacle; and a clamping assembly located on said container body on the face toward said cap, said clamping assembly comprising at least two clamping jaws one of which jaws is positionable by means of a cam attached nonrotatably to said cap such that the cross-section of said clamping assembly is set by the action of said cam to correspond approximately to the shank cross-section of said tool in said receptacle to which access is given by said tool removal opening.

2. The container defined in claim 1 wherein said clamping device comprises two clamping jaws, one of said jaws being affixed on said body and the other of said jaws being radially positionable, both of said jaws having two opposite right-angled clamping surfaces together forming a keyway fitting a square cross-sectioned tool, said positionable jaw being positioned by means of a sliding surface of said jaw opposite to the clamping surface of said jaw, said sliding surface bearing against said cam, said cam being formed by the boundary of a hole defined by a cam disk parallel to face of said container body.

3. The container defined in claim 2 wherein said cam possesses alternating clamping zones and adjusting zones, said clamping zones being positioned more circularly in respect to the axis of said cam, and said adjusting zones having larger radial excursions.

4. The container defined in claim 3 wherein by means of said cam said positionable jaw is tensioned when said tool-removal opening is in juxtaposition to one of said tool receptacles and is not tensioned when said tool-removal opening is between two of said tool receptacles.

5. The container defined in claim 2 wherein said cam disk is a circular inset disk with a diameter corresponding to the interior diameter of said cap, and linked nonrotatably to said cap by at least one matching projection and groove.

6. The container defined in claim 1 wherein said positionable jaw has a T-shaped profile in a plane perpendicular to its plane of motion, said jaw being guided in its motion by a corresponding T-shaped slot in said container body.

7. The container defined in claim 6 wherein the sliding surface of said positionable jaw which slides on the boundary of said cam plate has a semicylindrical form.

8. The container defined in claim 6 wherein at the closed end of said slot for guiding said positionable jaw there is a bore positioned longitudinally with respect to said slot, a spiral spring positioned in said bore, and a spherical centering g being supported on a spherical centering point on said positionable jaw.

9. The container defined in claim 1 wherein said container body has on the end away from said cap a gripping piece which is axially rotatable and axially movable between an engaged and an unengaged position, and teeth positioned on said gripping piece and said container body such that when said gripping piece is in the engaged position, the gripping teeth engage, and a spring being axially disposed between said gripping piece and said container body so as to restore said gripping piece to its unengaged position.

10. The container defined in claim 5 wherein the cap is made of plastic and the cam disk is made of metal.

* * * * *